United States Patent [19]

Bobkowicz

[11] 3,987,612

[45] Oct. 26, 1976

[54] METHOD AND APPARATUS FOR MANUFACTURE OF COMPOSITE YARN PRODUCTS

[76] Inventor: Emilian Bobkowicz, 400 Kensington, Westmont, Quebec, Canada

[22] Filed: Sept. 18, 1974

[21] Appl. No.: 507,054

[30] Foreign Application Priority Data

Sept. 19, 1973 United Kingdom ..... 43875/73

[52] U.S. Cl. ..... 57/34 HS; 57/35; 57/156

[51] Int. Cl.[2] ..... D02G 1/16; D02G 3/24

[58] Field of Search ..... 57/34 R, 34 HS, 34 B, 57/35, 58.89–58.95, 77.3, 140 BY, 156, 157 TS, 164, 162

[56] References Cited

UNITED STATES PATENTS

| | | | |
|---|---|---|---|
| 3,494,118 | 2/1970 | Bobkowicz et al. | 57/157 TS X |
| 3,621,646 | 11/1969 | Bobkowicz et al. | 57/140 BY |
| 3,844,097 | 10/1974 | Bobkowicz et al. | 57/34 HS |
| 3,848,403 | 11/1974 | Bobkowicz et al. | 57/164 X |

*Primary Examiner*—Donald E. Watkins
*Attorney, Agent, or Firm*—Robert J. Schaap; Ian Fincham

[57] ABSTRACT

An apparatus and process for forming yarn products. The apparatus has first yarn forming material supply means, collecting means for receiving the first yarn forming material, second means for supplying a second yarn forming material and for placing it in juxtaposition with the first yarn forming material, and means for transforming the composite material into a consolidated product.

41 Claims, 17 Drawing Figures

METHOD AND APPARATUS FOR MANUFACTURE OF COMPOSITE YARN PRODUCTS

This invention relates to a novel method and apparatus for the manufacture of novel spun yarns by a high speed linear spinning method, in which the spun yarns have a novel fiber arrangement, appearance and properties.

More particularly, this invention relates to a substantially improved method of linear open end type spun yarn manufacture as covered amongst others in Canadian Pat. No. 847,099. According to this reference, spun yarn can be manufactured linearly which contains a positive twist in spite of the continuous old basic spinning theory that to impart and retain a twist in a fibrous strand, it was considered imperative that either the yarn collecting and forming means (as in ring spinning or the fibrous strand collecting and yarn forming means in open end turbine spinning) must revolve about its axle. The inventor's linear brake spinning substantially neutralizes this obstacle and consequently facilitates high speed spun yarn manufacture by the utilization of any preferred false twist imparting means, but in a different manner than is the case in false twist texturizing of continuous multifilaments. This makes possible linear conversion of fibrous strands of staple fibers into twist containing spun by the utilization of interfiber slippage and twist differentials achievable during twist imparting in the inner and outer portion of staple fiber strands by the action of a preferred suitable false twist spindle to obtain the retention of an adequate amount of positive twist in spite of the substantial loss of the high speed twisting torque of the false twist spindle.

The method and apparatus of the present invention substantially improve, broaden, and amplify the previous possibilities in this art in respect to the basic method of linear spun yarn formation, consolidation, manufacture and scope, under more controllable conditions of manufacture of possible spun yarn types as well as spinability of a wide range of staple fibers. It reduces greatly the inherent technological speed limitations of ring and turbine open end spinning. Initial linear production speeds now attainable vary between 1,000–2,000 feet per minute and there are no inherent mechanical limitations to reach many times higher linear yarn output speeds — even about 10,000 feet per minute. With this invention it has now become possible to integrate into one compact mechanical assembly the fiber feed, drafting, strand consolidation, twist imparting and yarn collecting means, which will also enable the production of composite spun yarns comprising an inner continuous mono- or multi-filamentous carrier with or without an outside coated hot molten polymer resin of any suitable type. The latter is obtained by passing it through an extrusion die so that the tacky polymer surface may receive any preferred type and amount of staple fibers superimposed on it just before subjecting this continuous composite strand to a twisting torque of any preferred type known in the art, e.g. tubular or ring friction false twist spindle. Similarly composite spun yarns can be produced which may comprise only an inner continuous multifilament carrier and an outer staple fiber sheath in which the fibers are substantially interengaged and trapped within the multifilament carrier, due to the partially retained twist. This spinning system is also well suited to the linear production of 100% staple fiber content spun yarns which substantially resemble conventional ring or open end spun yarns. While the latter conventional spun yarns are highly limited in scope with respect to the use of staple fibers in the spinnability by said systems, the applicant's spinning system is substantially universal being capable of spinning staple fibers or blends thereof of substantially any origin, properties, staple length in a continuous fully integrated process in one apparatus at linear output speeds technologically unattainable upon conventional ring or open end spinning equipment.

In accordance with this invention, one embodiment of the apparatus comprises means for supplying a first yarn forming material, collecting means adapted to receive said first yarn forming material, means for supplying a second yarn forming material and for placing said second yarn forming material in juxtaposition with said first yarn forming material on said collecting means, at least one of the first or second supply means supplying particulate fibers, and means for transforming the resulting composite material into a consolidated yarn product. One preferred form is where the means for supplying the first yarn forming material in particulate form includes means for particulating a non-particulate material and forming a layer of the same on said collecting means. This may take the form of means for rendering a non-staple length source of fibers into staple length fibers, e.g. lickerin means, and means for advancing said staple length fibers onto the collecting means.

Correspondingly, in accordance with the method of the above aspect, the invention also provides a method of forming a composite yarn product, said method comprising the steps of supplying a first yarn forming material, placing said first yarn forming material on a collecting surface, placing a second yarn forming material into juxtaposition with said first yarn forming material, at least one of the yarn forming materials being particulate fibers and transforming the resulting composite material into a consolidated yarn product. A preferred form of this method includes the step of supplying the first yarn forming material in the form of particulate fibers or alternately, in another embodiment, in the form of a continuous strand of material, e.g. a filament.

In brief summary, according to a still further development, there is provided in a composite yarn manufacturing apparatus suitable for manufacturing spun yarn, the improvement wherein said apparatus includes means for subjecting the composite yarn to a source of pressurized gaseous material having a vortex configuration. Correspondingly, and according to a further aspect of this development, there is provided a method of manufacturing a composite yarn product, the improvement wherein said method includes the step of subjecting the composite yarn product to a source of pressurized gaseous material having a vortex configuration.

In a still further development, there is also provided in an apparatus suitable for forming a composite yarn product including means for supplying at least one source of particulate yarn forming material the improvement of first and second lickerin means, means for feeding said yarn forming material on said first and second lickerin means, collecting means, means for deflecting said particulate yarn forming material from said first lickerin means to said collecting means to form a layer of the same, means for deflecting said particulate yarn forming material from said second lickerin means to said collecting means at a point downstream from the point where said first deflecting means are located, and means for transforming the resulting composite material into a consolidated yarn.

In a still further development, there is provided in a twister for twisting composite yarn products having at least an inner layer of yarn forming material and an outer layer of fibrous material, the improvement wherein said twister includes means for expanding said outer fibrous layer. Correspondingly, there is also provided according to this, a method of twisting, during the manufacture of a composite yarn product having an inner and outer layer, the improvement which includes subjecting the outer layer to expansion during a twisting operation.

In a still further development, there is also provided the improvement in a process for manufacturing composite yarn products having an inner carrier and outer fibrous layer, in which the step of supplying an external amplifying force to at least one of said layers is included.

In the above described first embodiment of this invention, in place of the first yarn forming means providing yarn forming material in particulate form, a further aspect of this invention contemplates that it may be supplied as a continuous filament or carrier to the collecting means.

When the apparatus includes means for providing a first layer of a particulate yarn forming material this preferably comprises means for providing staple fibers from a source of fibers, and feeding the same into juxtaposition with the collecting means. Thus, there may be provided a source of fibrous material to be transformed into staple fibers, means for rendering the source of staple fibers into staple fibers, and including means for placing the source of fiber material into operative relationship with said last mentioned means, and means for feeding the resulting staple fibers to the collecting means. A lickerin or the like means adapted to render a source of non-particulated fibrous material into staple fibers and for feeding the same to the collecting means is preferred. Lickerin devices are well known to those skilled in the art — see Canadian Pat. No. 833,444. Briefly, such devices are adapted to utilise a length of fibrous material, and to break-down the material by combing or doffing into staple fiber lengths. The lickerin device may have wire wound teeth and/or similar projecting means — e.g. cutting knives or blades on its surface, to contact the source of fibrous material and de-fiberise it to provide staple length fibers. These lickerins rotate at relatively high speed and may be driven by suitable means, preferably a variable-speed drive.

Operating with the lickerin device are means for advancing a feed of the starting material to the lickerin; e.g. an advancing drum rotatable wheel, etc. The lickerin device will also aid as means for advancing the fibers thus obtained from the source of fibers and will direct them to the collecting means, since the high rotational speed of the lickerin normally permits fibers to be doffed and projected on a trajectory to the collecting means.

Using the lickerin device for providing a supply of stable fibers permits the source of fibrous material to take the form of fibrous board material, fibrous tow material or the like. Thus, continuous lengths of the fibrous starting material may be employed by the apparatus and method thus avoiding the necessity of utilising particulated staple fiber as a starting material. By virtue of this, there is achieved great economy in using a less expensive starting material and moreover, it permits a compact, single continuous apparatus and method for producing consolidated composite yarns.

A preferred collecting means comprises means to receive and form a layer of the staple fibers, when employed (or receive the lengths of carrier or filament material) and advance the same. The collecting means preferably comprises a single collecting surface movable between initial and terminal points whereby the staple fibers or filament from the first supply means are collected on the collecting means (in the case of fibers to form a layer of the same) and advanced from the initial point at which they are deposited thereon to and through the subsequent operations.

A preferred embodiment of the collecting means comprises a rotatable member rotatable about a fixed axis, said rotatable member having a collecting surface thereon, means for rotating said rotatable member, with said collecting means being mounted in operative relationship to the various means for providing the various components of the composite yarn forming materials. It will be understood, however, that other similar arrangements may also be employed if desired. A novel collecting means according to a further development may be employed which is illustrated hereinafter.

The collecting means preferably operates in conjunction with further means for aiding in the deposition and retention of the material on the collecting surface. Such means may comprise means for creating a differential pressure at the point where the first yarn forming material is placed on the surface of the collecting means and on the opposed side of the surface on which the staple fibers are collected. Thus, the collecting means may comprise a perforated drum, means within the drum for removing air from within the drum whereby there is created a flow of air from the exterior surface of the drum into the interior thereof with the perforations preferably being located adjacent the collecting surface for the material. The means for creating a differential pressure may be any suitable source of a partial vacuum-forming apparatus, connected by suitable conduits or the like to the interior of the collecting drum or surface. The means for creating a differential pressure operates in conjunction with the various means for providing the different yarn forming material and in conjunction with the consolidating means; however, as will be understood by those skilled in this art, if employed, the differential pressure creating means may be applied only to certain operations or as individual means to assist individual operations.

The apparatus and method may further optionally include means for employing, in juxtaposition with the first yarn forming material (either the carrier filament or layer of staple fibers), a material functioning as an inter-fiber binding material to produce a binding effect between the first yarn forming material and the second particulate yarn forming material.

In the aspects wherein the first yarn forming material is supplied in a particulate or staple length fiber form, this comprises means for extruding a filament of inter-fiber binding material onto the collecting means in juxtaposition to the first yarn forming fibers to produce a binding effect between the first and second layers of staple fibers. Such extrusion means are well known to those skilled in the art and need not be discussed in greater detail herein. The inter-fiber binding material may be any suitable extrudable polymer resin or resin blend, e.g., thermoplastic resins such as, for example, polyamides, polyesters, polyolefins such as polyethylene, polypropylene, etc., acrylonitriles, etc. The particular choice of inter-fiber binding material will depend on the properties desired in the composite yarn structure, the economics of such materials, etc. The extrusion of the inter-fiber binding material is carried out such that the filament of polymeric material, when placed in juxtaposition with the first layer of yarn forming material, is at least in a tacky condition to function as an inter-fiber binding material. Thus, depending on the type of material employed, the various extrusion temperatures and other criteria will vary on factors well known to those skilled in this art. When utilizing thermoplastic, resins as inter-fiber binding materials, the filament extrusion will be carried out at a temperature such that when the filament of inter-fiber binding material is placed in juxtaposition with the first layer of staple fibers, it is at least in a tacky condition and will remain so until the second layer of staple fibers has been formed and applied to the composite structure.

In the embodiment wherein the carrier strand or filament is utilized, the carrier may be fed through the extrusion device to be coated with the inter-fiber binding material. Subsequently, the thus-coated carrier material is placed on the collecting means in juxtaposition with staple length fibers to form the composite yarn.

In a further embodiment of the above, the apparatus may be operated with an extrusion device capable of being switched on and off with the carrier material running therethrough. Thus, when desired, the apparatus may be operated to form a two-component yarn wherein the carrier strand is coated with the inter-fiber binding material and placed in juxtaposition with a source of staple length fibers. Alternatively, the extrusion device may be "run dry" whereby the carrier filament may continue to run through the extruder without any inter-fiber binding material being applied thereto. In this embodiment, a two-component yarn comprising an inner carrier filament with staple length fibers interlocked therewith may be manufactured.

The carrier may also be introduced through the collecting means other than through the extruder. Thus, for example, means may be provided to introduce the yarn to the collecting means and at the same time treat the carrier with desired agents as will be discussed in greater detail hereinafter.

The carrier, if and when introduced, may comprise any type of multifilament strands, fibrillated tapes, a continuous thermoplastic tube, or even low cost staple fibrous spun yarns, such as jute, sisal, flax, glass, asbestos, waste fibers or Kraft paper to provide a low cost inner bulk and a better more textile-like outer appearance.

The apparatus and method also includes means for supplying a second layer of staple fibers which may be similar to the first supply means when it supplies particulate fibers. Thus, there may be employed a lickerin assembly, a source of pressurized gaseous fluid material to aid in the deposition of the staple fibers, and a source of pressurized air or the like directed onto the collecting surface, in advance in the direction of movement of the collecting means, functioning similarly to the source of pressurized air located in advance of the spraying means.

It will be understood that wherein reference is made to a one component yarn product, such a product may comprise one or more materials, however, both of these materials are particulate yarn forming materials. A two component yarn designates a yarn comprising a carrier having at least one further layer of particulate yarn forming material thereon. A three component yarn product comprises an inner carrier, an inter-fiber binding material, and at least one layer of staple length fibers.

Furthermore, in the embodiment wherein a carrier material is utilized, only one source of particulate yarn forming material may be employed. Wherein the apparatus includes two sources of particulate yarn forming material, either one of said sources may be employed or alternatively, both sources of particulate yarn forming material may be used.

The various means for applying a source of pressurized air to the collecting surface, or to the means for supplying a second layer of staple fibers, may be operated as a single continuous circuit with suitable valve means interposed between the respective steps or components and they may be manually or automatically controlled to provide the desired degree of pressure and volume of gas.

The apparatus may also include means for consolidating the composite yarn structure. Any suitable means may be employed. It may assume the form of a pressure roll operating in conjunction with the collecting means to compress the composite yarn to form a consolidated composite yarn product — e.g. a tape or strand.

Means may also be provided for applying by spray or other technique various types of additives to the yarn forming materials at for example the collecting means or other locations. Such means may be connected to one or more sources of additive materials, e.g. supplied under pressure. The properties of the composite yarn may thus be modified as desired, depending on the type of additive, during the manufacture and formation of the yarn product. The spraying means may spray various types of additives known in this art; they include, e.g., lubricating agents, latex and combing agents, sizing agents, bonding agents, lattices, plastisols, etc.

Following production of the consolidated composite yarn product it may then be subjected to any conventional treatment, such as twisting, etc. by conventional apparatus when it is desired to form yarns. Alternately, the yarn may be wound into rolls of the same and subsequently treated if desired.

The applicant's novel method and improved concept of spun yarn production enables the manufacture at high linear output speeds of a novel type of spun yarn which outer fiber ends will be forced to helically wrap around the inner fiber strand or filament sections at twist arrangement substantially opposite to the twist direction of the inner portion which inherent untwisting tendency amplifies the interengagement and consequent liveliness and strength of the yarn, similarly to plied yarns, as long as the yarn is under controlled conditions in a package or fabric and thus not permitted to untwist.

The preferred method of forming such dual opposite twist containing yarn is by continuously feeding one or more fiber strands supplied preferably by fiber lickerin feeding means onto or into a groove of a revolving perforated roll provided from within with adequate strong suction to control the restrained fiber movement while subjecting said fiber strand to a twisting torque of any preferred high speed false twist spindle before linear wind up into large size yarn package upon any suitable winder. While passing through the false twist spindle the right twist above the spindle and the left twist below the spindle have the tendency to annul each other, however, before this can take place the opening loose fiber ends at the upper part of the spindle are in inventor's system subjected to a higher velocity twist than the inner staple strand with the result that before the untwisting forces within the spindle can materialize the higher velocity applied in the upper part of or just below the spindle will wrap the fibers around the yarn in opposite direction to the basic inner twist, which when subsequently meeting the untwisting forces will result in a tight yarn with inner and outer opposite each other restraining twists. In spite of some loss of the inner basic twist the resulting yarn will for all practical purposes meet most of the requirements of a spun yarn. The relation between the outer and inner twist will be governed by many factors such as speed, frictional forces, fiber properties, twist differential which can be engineered to meet specific requirements.

In use of the apparatus and process any suitable staple fiber source may be provided; the particular type of staple fiber well known to those skilled in the art will be chosen depending on the properties desired in the consolidated composite yarn. Also, the fiber length may be controlled as desired when using a continuous source of starting material for the staple fibers.

In the above-described apparatus and process, a plurality of the lickerins may be mounted in a single machine each feeding a separate collecting surface. More than two separate sources of staple fibers may be provided if desired depending on the type of product desired and the properties desired for those products.

The present invention provides a very compact system for forming novel composite yarns having improved properties. It is now possible to produce composite yarns in a single apparatus from a continuous source of the starting material, without having to provide particulate starting materials as previously required. Also, the addition of different additives to the yarns as they are being formed is possible with the use of the spraying means, and the technique of spraying the inter-fiber binding material, or thermoplastic polymer, provides a very uniform coverage for the composite yarn permitting the first and second sources of staple fiber to adhere to the sprayed inter-fiber binding material. Further, the invention possesses a significant economical advantage compared to conventional yarn forming techniques, for producing more economical yarns.

Having thus generally described the invention, reference will now be made to the accompanying drawings illustrating several embodiments thereof, and in which.

Figures 12, 13, 14:
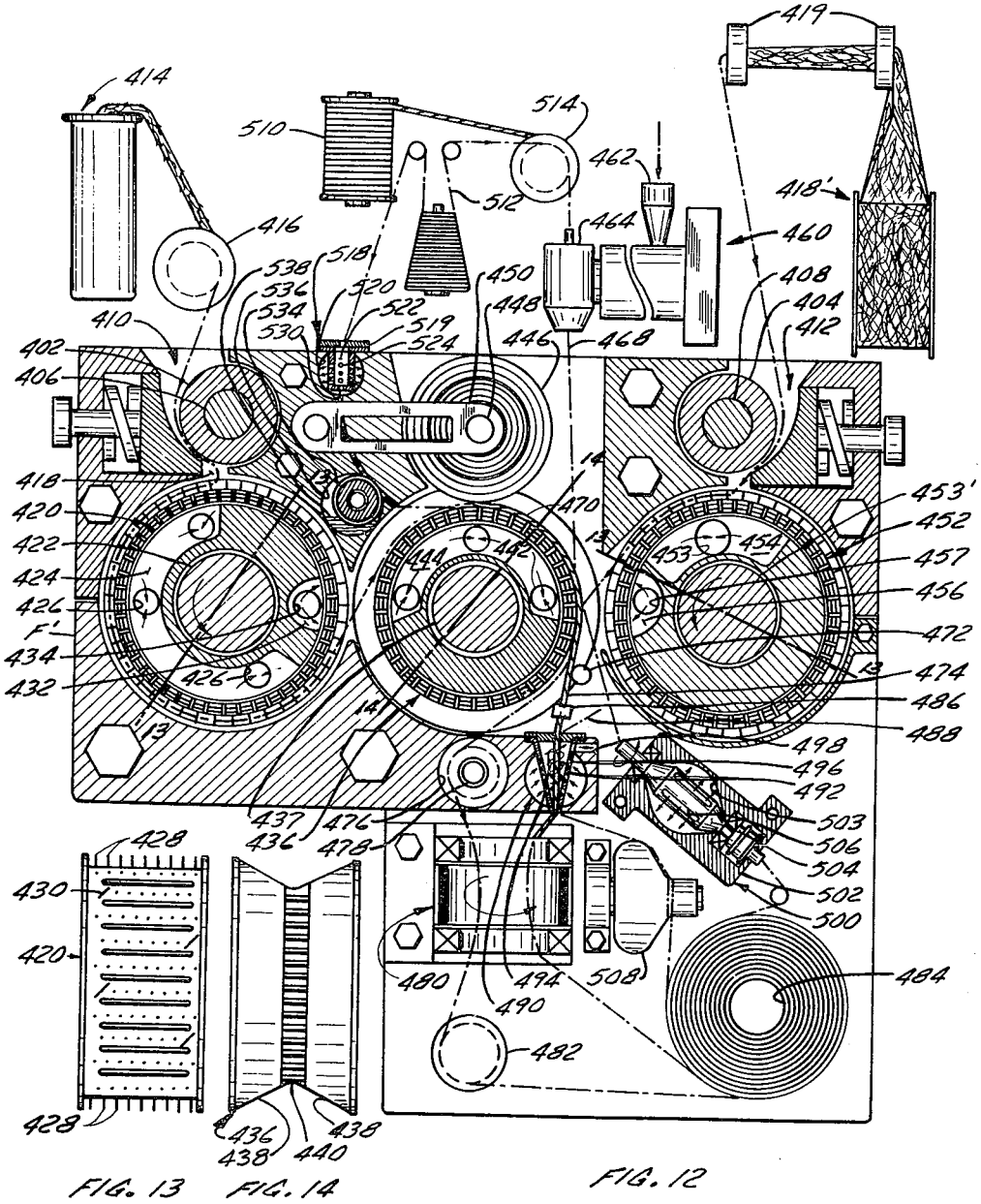
Figure 15:
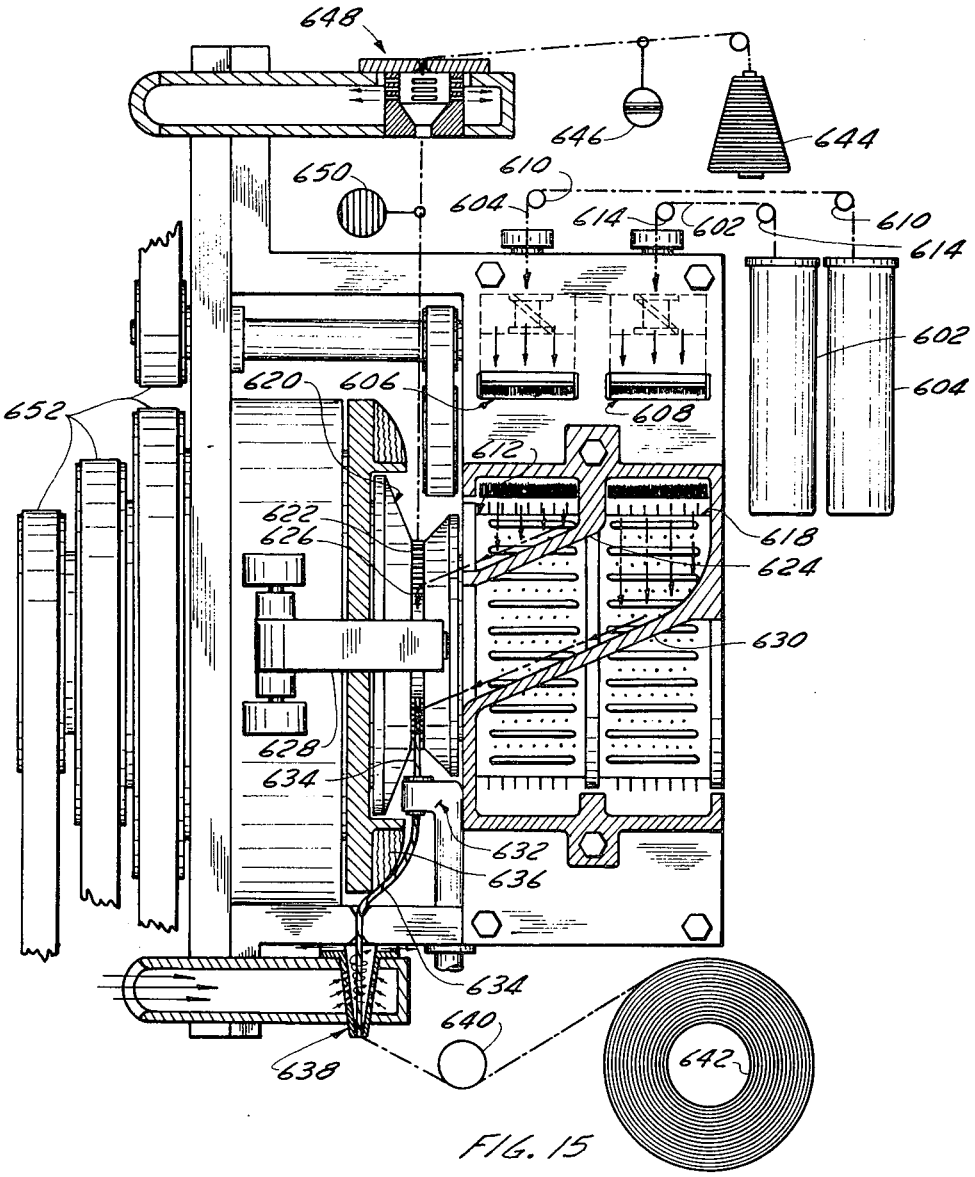
Figure 16:
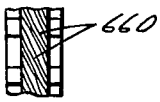
Figure 17:
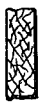

FIGS. 6 to 12 schematically illustrate the various sources of raw materials that may be employed with the apparatus of the present invention;

FIG. 12 is a cross-sectional view of a composite yarn product manufacturing apparatus according to a further embodiment of the present invention;

FIG. 13 is a section taken along lines 13—13 of FIG. 12;

FIG. 14 is a section taken along the line 14—14 of FIG. 12;

FIG. 15 is a top view of a further embodiment of the invention;

FIG. 16 is an enlarged view of the composite yarn product after deposition of the second yarn forming material; and FIG. 17 is an enlarged view of the yarn product after further processing.

Figure 1:
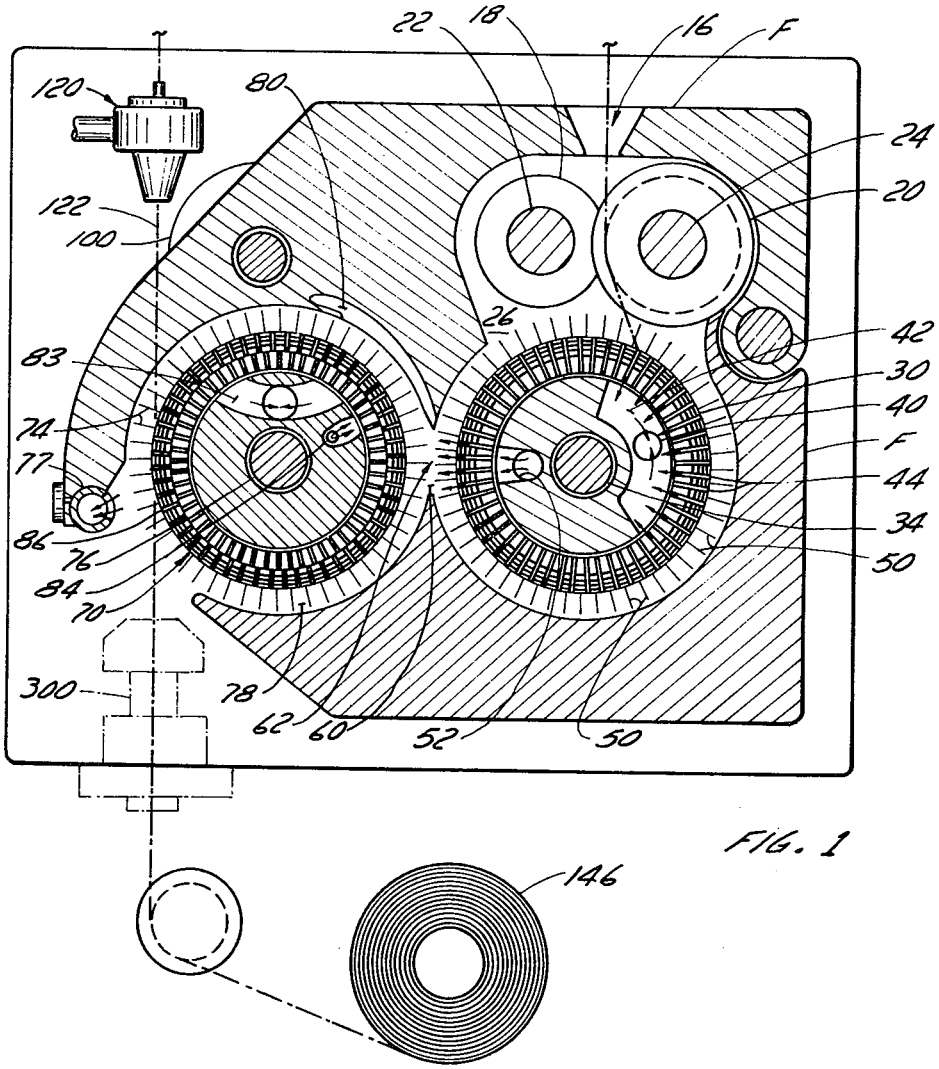
FIG. 1 is a cross-sectional view of a composite yarn product manufacturing apparatus.

Referring to FIG. 1, the various support or frame members of the apparatus are designated by F. The apparatus includes an inlet or mouth opening 16 for the feed-in of the various yarn forming materials. This includes a pair of opposed two-position feed-in pressure rolls 18 and 20 journalled on shafts 22 and 24 respectively which are rotated in counter directions by suitable device means. In a preferred embodiment, roll 18 fits within the circumferential edges of roll 20 to prevent the exit of material between the side edges of the rolls.

Rolls 18 and 20 are located within a cavity 26, which comprises an elongated chamber having a lower portion of a circular nature. Within the lower portion, there are a pair of needle rolls 30 and 32, mounted on a common shaft 34 with suitable drive means (not shown) for rotating the rolls. Needle rolls 30 and 32 may be driven at a somewhat higher surface speed than pressure rolls 18 and 20 to achieve a slight fiber combing action. Rolls 30 and 32 may be of a conventional construction as is well known to those skilled in this art. When driving rolls 30 and 32 at a higher rotational speed than rolls 18 and 20, in addition to a combing action, fiber parallelization will also occur - the extent of this characteristic depending on the difference in the rotational speed.

Figure 3:
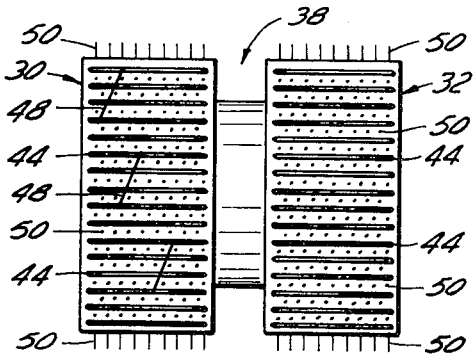
FIG. 3 is a view of the needle rolls of FIG. 1.

Rolls 30 and 32 (FIG. 3) are mounted in a spaced-apart manner with a gap 38 therebetween; preferably, the rolls are constructed as illustrated in FIG. 1 and include means for creating a suction or a negative pressure at or near the point where fibers are fed to rolls 30 and 32. The suction means includes a conduit 40 connected to a source (not shown) for withdrawing air. Conduit 40 is in a chamber 42 interiorly of the surface of the roll and chamber 42 communicates with the surface of the rolls 30 and 32 through a plurality of apertures 44, (FIG. 3). Chamber 42 extends throughout only a portion of the distance of the circumference of the surface of the rollers 30 and 32, and the creation of a partial vacuum aids in the deposition of the fibers onto the needle rolls. Thus, in this embodiment, the outer surface of the rollers 30 and 32 are free to rotate relative to the chamber 42.

Needle rolls 30 and 32 may optionally include one or more knife blades 48 or like cutting means mounted in an angular relationship to their transverse axis and between adjacent rows of the needles 50. Various equivalents of such needles on rollers 30 and 32 may also be employed.

There also may be provided pressure applying means within rollers 30 and 32 to transfer the fibers carried by the rollers 30 and 32 to the next step and component of the apparatus. Thus, a source of pressurized gaseous material, e.g. air, carried by a conduit 52 interiorly of rolls 30 and 32 may be used so that the air passes to the outside of rolls 30 and 32 through apertures 44 at the point of fiber discharge, as indicated by reference numeral 60. For this purpose, the apparatus also includes a discharge port 62 where the fibers are transferred onto a pair of opposed lickerins 70 and 72, located opposite rollers 30 and 32 respectively.

The construction of the lickerins is well known in this art. In brief summary, the lickerins include a rotatable outer surface on which there are mounted a plurality of needles or teeth 74; the lickerins are mounted spaced apart on a common shaft 76 with a gap or opening 79 between them.

Suitable drive means 85 drive lickerins 70 and 72. The lickerins are mounted in a cavity 78 of the apparatus. Where the fibers are transferred from rollers 30 and 32 onto rollers 70 and 72, cavity 78 includes a further recessed portion 80, the function of which is hereinafter described.

Where the teeth 74 of lickerins 70 and 72 engage the fibers, due to the frictional forces of the high speed lickerin roll surface, further combing and drafting of the fibers occurs, which may be controlled as desired by varying the rotational speed of the lickerin. The lickerins 70 and 72 may be respectively rotated at different rotational speeds to impart different degrees of combing and drafting to the fibers.

The lickerin structure of FIG. 1, includes deflecting means for removing the fibers from the teeth 74 of lickerin 70 at a point spaced from the point at which the fibers are engaged. A preferred means comprises a source of pressurized air (not shown) carried by conduit 84 interiorly of lickerin 70, directing air through apertures 86 in the lickerin surface. Apertures 86 communicate with the exterior of the lickerin to release the fibers from engagement with teeth 74. This preferred means operates in conjunction with the centrifugal forces of the lickerin 70 so that the fibers are released from the needles and thrown into the cavity 80 which guides the "free" fibers towards the central portion of cavity 80.

Between lickerins 70 and 72, there is provided collecting means comprising a groove structure to receive the fibers from lickerin 70 and form the fibers into a layer of the same. The collecting means includes a center roll with a pair of tapering side walls 90 in opposed relationship, meeting a further pair of tapering walls 92, which in the central area, form the collecting surface. The inner fiber collecting roll may revolve on the same shaft as the lickerin rolls 70 and 72. The outer areas of walls 92 preferably include a plurality of apertures 96 communicating with the interior of the central area of the structure, having suction means to aid in the deposition of the fibers in the collecting trough. The central portion of the structure (e.g. FIG. 2) includes a cavity 83 with a conduit therein, connected to a vacuum source to create a partial vacuum in chamber 83. This permits exterior air to be drawn into the cavity 83 through the apertures 96.

Lickerin 72 is likewise preferably similarly constructed to lickerin 70. Thus, fibers conveyed onto the needle 74 of lickerin 72 are deposited on the collecting surface or the trough by means of a cavity 97 (similar to cavity 80). The termination point of cavity 97 is in advance, in the downstream direction of the fiber movement, of the point at which the fibers from cavity 80 are deposited onto the collecting surface. If desired, the use of a similar arrangement described above with respect to lickerin 70, in the form of a jet or source of pressurized air, may be used for removal of the fibers from the needles 74.

A pressure roll 100 (FIG. 1) is employed at a point subsequent to which the fibers from lickerin 70 are laid down on the collecting surface. Preferably roll 100 is located in advance of the point where fibers from lickerin 72 are laid down so that it is between the two points from which the fibers from the first and second lickerin are deposited.

Figure 7:
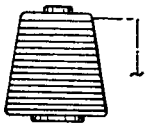
Figure 6:
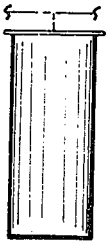
Figure 8:
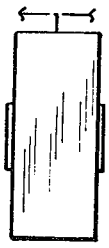

The source of the fiber material for feeding may take any form of the conventional set-ups illustrated in FIGS. 6 to 11. Thus, in FIG. 6, any staple fiber in card sliver or roving form can be used for conversion into spun yarn or yarn product by the apparatus and process of the invention. In FIG. 7, the multifilaments or monofilaments can be used to feed the yarn system either through the extruder 120 to provide a polymer resin coating useful in the manufacture of multicomponent composite yarns, or directly without polymer coating by feeding it directly into the fiber strand consolidation roll. As indicated in FIG. 8, a polypropylene oriented tape or any other suitable polymer film can be fed directly into the assembly where it can be fibrillated into individual fibers and the latter converted into spun yarn or a yarn product yielding obvious economic improvements.

Figure 9:
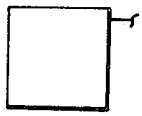

In FIG. 9, standard film and tow manufactured for staple fiber production can be converted into spun yarns either in a continuous carrier or staple fibers which will be cut by the blades 48 mounted in the feed-in rolls (FIG. 3). In FIG. 3, one of the rolls 30 has been provided with blades 48; both may include the blades if desired.

Figure 10:
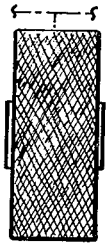
Figure 11:
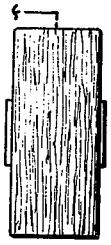

In FIG. 10, any fiber webs of staple fibers, arranged at random, can be fed into the apparatus of FIG. 1 and converted directly into spun yarns or a yarn product. In FIG. 11, long staple bast fiber card rolls, e.g. from jute, ramie, flax, etc. can be fed into the apparatus, broken up into shorter fibers by the rollers 30 and 32, and subsequently converted into spun yarns or yarn products.

If desired, (see FIG. 1), an inter-fiber binding material may be introduced between the points at which the first fibers are laid down in the collecting groove and the point at which the second fibers are likewise laid down. To this end, any suitable means, such as an extruder 120, may be employed for extruding a molten or at least semi-molten inter-fiber binding material 122 — e.g. polymeric material, onto the layer of the first fibrous material.

As illustrated in FIG. 1, the apparatus may include means of supplying differential pressure in proximity to the point at which the two partially consolidated layers of yarn forming material leave the collecting surface or trough. Such a differential pressure means may be similar to those described earlier; thus, there is shown in FIG. 1 a conduit 77, this conduit leading to a vacuum supply means (not shown). The vacuum supply means may operate in conjunction with similar means employed in this invention. In this particular embodiment, the vacuum means operate to remove the dust or "fly" from the yarn formed and from the trough in which the yarn has been removed. The rotating surface is thus cleaned and is ready to receive a new layer of yarn without contaminating the latter.

Figure 4:
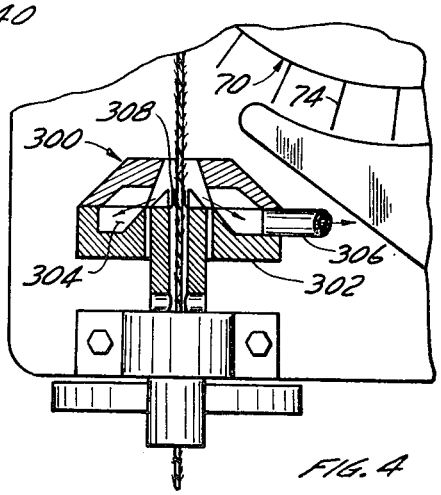
FIG. 4 illustrates a false twisting device, partially in section, as illustrated it being a component of the apparatus of FIG. 1.

Following formation of the composite material, the resulting product may be treated, if desired, by for example, subjecting it to a twisting torque by passing it through a suitable twisting device (FIG. 4). The device of FIG. 4 is, in part, a conventional high speed false twisting spindle, and certain of such devices are capable of operating at speeds of 1,000,000 rpm. The part that is not conventional is designated by numeral 300 and includes a housing 302 about a spindle with an internal chamber 304 and an outlet conduit for air 306. Surrounding the inlet where the composite yarn enters, there is an aperture 308 communicating with chamber 304 and upon drawing a vacuum, the fibers on the composite yarn are caused to stand outwardly and to provide a "hairiness" to the yarn. The balance of the twisting device structure is conventional and is well known.

As a result of the twisting torque applied to the material passing through the twisting device, the first fiber strand, which is restrained by the pinch point created by the pressure of the rotating pressure roll, is subjected to a more positive fiber consolidated twist whereas the second fiber layer, coming from the second lickerin 72 will be placed in contact with the pretwisted first fiber strand thus engaging the second fiber layer into a relatively loose twist in the same direction around the first strand so that the formation of a greater fibrous balloon of fiber ends at the entrance of the false twist spindle occurs; preferably, this is aided by mounting on top of the spindle entrance an element which may provide suction or an electrostatic field to optimize the twisting of the loose fibers slightly restrained under tension with the further aid of a preferably serrated entry of the false spindle tube. The provision of suction means, or means for creating an electrostatic field, may be provided for by any suitable component capable of effecting the desired function, and which components per se are known to those skilled in those arts.

The above components and the process carried out thereby, results in the formation, with the narrow inner false spindle tube, due to the frictional and fiber restraining forces described above, of the twisting of the loose ends in an opposite twist arrangement to the twist of the inner fiber strand, when the spindle rotates in the same direction as the direction of the twist of the inner fib er strand - however, to achieve the desired opposite twisting result, the spindle must revolve at a substantially higher speed than the speed at which the inner strand layer is rotating so as to form the desired double opposite twisted spun yarn.

Figure 2:
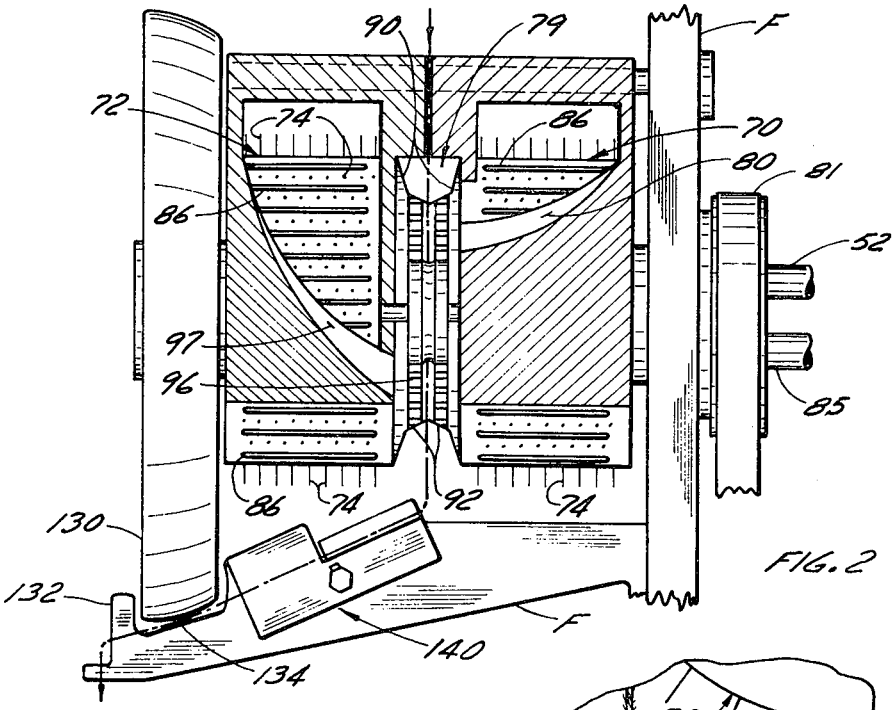
FIG. 2 is a partial sectional view of the lickerin structure of FIG. 1; the apparatus illustrated in FIG. 2 is substantially that of FIG. 1 except that it includes an additional element as described hereinafter.

A modified version is also shown (FIG. 2) modified to include a frictional disc and an optional different type of spindle. Otherwise, the arrangement of FIG. 2 is substantially identical to FIG. 1.

As modified, there may be provided a frictional disc 130 mounted on a suitable shaft and driven by suitable means (not shown). A lower frame member 132 contains a recess 134 therein in which disc 130 is adapted to rotate. Disc 130 actually engages the surface of the recess 134. As illustrated (FIG. 2) the resulting composite yarn structure, after being taken off from the collecting surface, may optionally pass through a tubular spindle 140, and then between the surface of recess 134 and disc 130. By passing only between disc 130 and the surface of recess 134, the material may be subjected to a unidirectional twist resulting in a unidirectional twisted yarn which although useful for many purposes, does not have all of the advantages of the above-described yarn.

Disc 130 may be operated on the same shaft as the fiber feed and yarn consolidation assembly if desired — alternately, separate drive means may be employed for this purpose. Preferably, disc 130 has a tapered surface (FIG. 2), and likewise, the surface of the recess 130 is also tapered.

Figure 5:
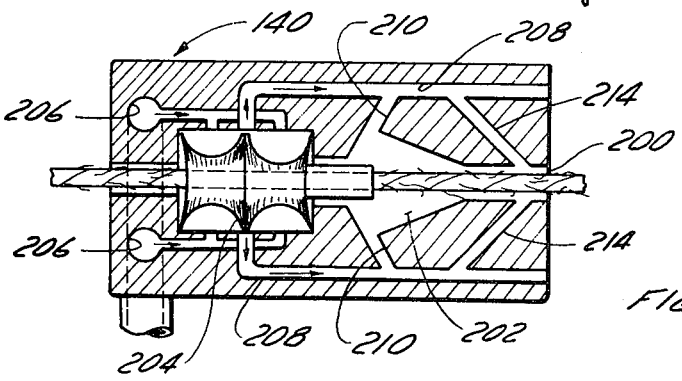
FIG. 5 is a sectional view of a tubular spindle included in the modified apparatus of FIG. 2 and which may be employed as an alternate component for the apparatus of the present invention.

To achieve, in a preferred embodiment, the same double twist as described above, with a false twist spindle type, there may be incorporated an aerodynamically driven tubular spindle device 140 (FIG. 5) located between friction disc 130 and fiber strand consolidation groove 92. The spindle includes an inlet 200 to receive the yarn product, which inlet opens to a tapering chamber 202, which leads to an air chamber having a tubular disc 204 with a serrated surface. Disc 204 is freely mounted and a source of compressed air from conduits 206 leading to the chamber through communicating passages causes the disc to rotate or revolve at high speed, substantially exceeding the speed of the inner supporting fiber strand driven by the disc. The disc 204 journals the fiber strand, which is under tension, as it passes through disc 204. It performs the role of a bearing on which the tubular spindle is driven. Preferably, in this device, the compressed air is introduced into the chamber in which the disc 204 is mounted, at various points surrounding the disc. Outlet ports for the pressurized air are indicated generally by reference numeral 208; there may be provided conduits 210 communicating with conduits 208 whereby the escaping pressurized fluid will withdraw pressure from chamber 202. Conduits 214 may also be provided communicating with entrance 200 and with conduits 208 to create a suction at the entrance where the yarn enters the device and before it enters the floating disc arrangement. Thus, any similar arrangement can be used for imparting the basic twisting torque by any friction twisting means and supplement the latter by a separate tubular twisting torque both operating in the same twisting direction provided the tube will operate at substantially higher twisting speeds than the yarn passing through a friction twister and that the tube will be designed to meet the above basic requirements.

The present invention has more advantageous features in the latter embodiment compared to use of the false twisting device of FIG. 4, in that the twisting speeds of the twisting disc and the separate twisting tube can be operated at any preferred differential in surface speed and even in an opposite direction to each other. This enables the manufacture of a novel type of yarn wherein the fiber strand is first provided with a pretwist in one direction and, in the subsequent tubular spindle operating in an opposite direction, forcing the substantially loose second fiber layer to twist in the same direction and thus impart substantially added twist to the unidirectionally twisted yarn. The inner fiber layer-twist, imparted by the false twist unit, will have the tendency to untwist thus amplifying the desirable outer hairiness, and any twist loss will be immediately conpensated for by the possibility of revolving said tubular spindle, which may be mounted as described above or alternatively after the twist imparting revolving friction disc, at a preferred higher speed which will force the loose fiber ends to twist around the inner strand in a truly open end twisting manner under highly controllable variable conditions to produce at very high speed, linearly open end substantially unidirectional twisted spun yarns, from any type of staple fibers which can be handled by the fiber feed-in means as shown in FIGS. 3, 6, 7, 8, 9, 10 and 11. The resulting composite yarn from the above process may be gathered according to conventional techniques and wound into rolls of the same, such as is indicated by roll 146.

Further embodiments of the present invention are illustrated in FIGS. 12 to 14 and reference will now be made thereto.

The composite yarn manufacturing apparatus of FIG. 12 has its frame or support members designated by reference character F′ and includes a pair of feedin pressure rolls 402 and 404 journalled on shafts 406 and 408 respectively. As shown, mouth portions 410 and 412 are provided to permit the feed-in of various yarn forming materials to pressure rolls 402 and 404 respectively.

A first source of yarn forming material 414 is fed over guide roll 416 through mouth 410 to pressure roll 402 and discharged at exit portion 418 to a needle roll designated generally by reference numeral 420. Similarly, yarn forming material 418′ is fed about suitable guide members 419 to mouth 412 of pressure roll 404 and then discharged to lickerin roll 452. It will be understood that suitable means are provided for rotating rolls 402, 404, 420 and 452. The construction of such rolls is similar to that described with respect to FIG. 1 and detailed reference will not be made thereto.

As shown, lickerin 420 is journalled on shaft 422; lickerin 420 includes needles 428 and cutting blades or knives 430, the effect being a combing action and parallelization of the fibers. As illustrated, a chamber 424 is provided internally of lickerin 420 for at least a portion of the circumference thereof; chamber 424 communicates with the exterior portion through apertures provided within the surface of lickerin 420. In a manner similar to that described with respect to FIG. 1, conduits 426 are provided within chamber 424 and are connected to means (not shown) for withdrawing air through the conduit whereby a suction is created in chamber 424 thus aiding in the deposition and retention of the fibers on the surface of lickerin 420.

If desired, in the apparatus of FIG. 12, a further chamber 432 may be provided, chamber 432 communicating with conduit 434 connected to a source of pressurized gaseous material — e.g. air; the pressurized gaseous material thus will aid in the transfer of the combed and drafted staple fibers onto a collecting roll designated generally by reference numeral 436.

Collecting roll 436 is journalled on shaft 437 and functions in a manner similar to the collecting roll described with respect to FIG. 1. Thus, collecting roll 436 includes a pair of tapering side walls 438 and a central collecting trough 440 having apertures (not shown) therein. The apertures communicate with a cavity 444 located interiorly for a portion of the circumference of collecting roll 436. Conduits 442 also communicate with cavity 444 and are connected to means (not shown) for withdrawing air through the conduit; this creation of a partial vacuum aids in the deposition and retention of the staple fibers on the collecting trough 440.

In the illustrated embodiment, there is shown a pressure roll 446 which is rotatable about shaft 448 and is connected via arm 450 to frame F′. Pressure roll 446 formations in a manner similar to that described with respect to pressure roll 100 in the embodiment of FIG. 1.

As discussed above, a second yarn forming material 418′ is fed into the apparatus of the present invention and in particular, through mouth 412 where it is discharged from roll 404 to lickerin 452 which is journalled on shaft 453′. Lickerin 452 rotates in the direction illustrated by the arrow and is of a construction similar to that described with respect to lickerin 420. Thus, a conduit 453 within cavity 454 is connected to a means of supplying suction whereby the fibers are retained on the surface of lickerin 452. Also, a further cavity 456 is connected by conduit 457 to a source of pressurized gaseous material in order to transfer the staple fibers from the lickerin to collecting roll 436.

In one aspect of the present invention, and in accordance with the method and apparatus for manufacturing a one-component yarn, the first yarn forming material 414 is fed through lickerin 420 and a layer of staple fibers deposited on collecting trough 440 of collecting roll 436. The resulting layer of yarn after passing under pressure roll 446 is restrained; pressure roll 446 also serves to provide tension to the strand to enhance the consolidation and formation of the consolidated yarn as will be described hereinafter. Strand or filament 470 then has deposited thereon a second layer of fibers from lickerin roll 452. The resulting composite material is then transformed into a consolidated yarn by further steps which will be discussed in greater detail.

In an alternative embodiment, a composite yarn product may be formed utilizing an inter-fiber binding material. To this end, there may be provided an extrusion device 460 which includes an inlet 462 for supplying the inter-fiber binding material to the extruder, and an extruder nozzle 464 to extrude a filament or strand 468 of the inter-fiber binding material. Extruder 460 will extrude a molten or at least a semimolten inter-fiber binding material such as a polymeric material onto yarn forming material 470 following which a further layer of fibers may be deposited thereon from needle roll 452.

In a still further embodiment of the above, a strand or filament of a carrier material may be provided to pass through extrusion nozzle 464 whereby the strand of carrier material is coated or otherwise has applied thereto the inter-fiber binding material. Thus, as shown in FIG. 12, carrier material 510 or 512 passes over a guide roll 514 and thence through extruder 464 to collecting roll 436. In this embodiment, only one source of fibrous material may be utilized if so desired. There would thus be obtained a three-component yarn comprising an inner carrier, an inter-fiber binding material, and an outer layer of fibrous material.

In an alternative aspect of the above embodiment, a strand of carrier material 512 may be utilized without being coated with an inter-fiber binding material. To accomplish this, carrier material 512 may be fed to extruder nozzle 464 while the same is "dry" or non-operational. By so doing, a yarn product comprising an inner carrier and an outer layer of staple fibers interlocked therewith may be obtained.

Even further, carrier 512 may be subjected to further steps if so desired. Thus, as shown in FIG. 12, a suction device 518 is provided; suction device 518 is set within cavity 520 of frame F′ and has a housing 519 and interior cavity 522. Cavity 520 is connected to suction means (not shown) and via apertures 524 within housing 519, the suction is communicated to the interior 522 through which carrier 512 passes. The suction where negative pressure will thus tend to "expand" carrier material 512. In the case wherein carrier material 512 is a fibrous material, the negative pressure will thus cause a greater hairiness on the outside thereof which hairiness will enhance the interlocking properties of the carrier material with the staple fibers when subjected to a twisting operation.

Carrier material 512 may then pass through an internal conduit 530 with frame F′ to collecting roll 436. If desired, and as shown in FIG. 12, a kiss roll 534 mounted within cavity 536 may be provided. Cavity 536 may contain an agent 538 for treating carrier material 512; such agents may include, for example, glue agents, lubricating agents, and other such agents known to those skilled in the art. Following the above steps, carrier material 512 will be placed in juxtaposition to trough 440 of collecting roll 436 in the manner described above.

Optionally, a further pressure roll 472 may be supplied to subject the composite material to a partial consolidation operation. In this embodiment, pressure roll 472 would aid in creating a pinch point for a twisting operation. It is understood that pressure roll 472 may be mounted in any manner known to those skilled in this art.

As aforementioned, many different types of materials may be utilized both in forming a carrier strand and in forming staple fibers. In one embodiment, low melt thermoplastic material may be utilized and in such an embodiment, the material may be subjected to a still further operation. To this end, heating means 486 may be incorporated in the apparatus of the invention to further treat yarn 474. Heating means 486 may comprise a heating zone through which strand 474 passes whereby the same is rendered tacky. Following passage through heating means 486, a further source 488 of fibrous material may be placed in juxtaposition thereto. To this end, any suitable means including pneumatic means may be employed in depositing such fibers on strand 474.

Following the formation of the composite material according to any of the above-described embodiments, transforming means for transforming the resulting composite material into a consolidated yarn product may be employed. Such transforming means, as outlined with respect to FIGS. 1, 4 and 5, may assume a number of different configurations and reference herein will be made to some of such configurations.

In one aspect, the composite material taken off collecting roll 436 may pass over roll 476 journalled on shaft 478 to a twisting device designated generally by reference numeral 480. Twisting device 480 is of a conventional type well known to those skilled in the art and need not be described herein.

Alternatively, in one embodiment of the present invention, there is provided a conduit 490 within frame F, conduit 490 being connected to a source of pressurized gaseous material such as air. Mounted within conduit 490 is a housing 492 having an inverted conical configuration, apertures 496 within the walls of housing 492 providing communication between conduit 490 and the interior 494 of housing 492. As indicated schematically in FIG. 12, the pressurized gaseous material entering apertures 496 assumes a vortex or whirlpool configuration within the interior 494 whereby the outer layer of fibrous material is amplified. A discharge conduit 498 is provided for the egress of the pressurized gaseous material.

The composite material may then be passed through twister 480 which, as a result of the twisting torque applied to the material passing through the twister 480, the inner fiber strand which is restrained by the pinch point created by the pressure of the rotating pressure roll, is subjected to a more positive fiber consolidating twist. Due to the frictional and fiber restraining forces aforementioned, wherein the spindle of the twister rotates in the same direction as the direction of twist of the inner fiber strand, the outer fibrous layer will be twisted about the inner strand in an opposed direction. While the inner fiber strand will tend to untwist itself, this will cause the outer fibers to assume a much tighter twist thereby locking in a twist to the yarn.

As shown, the yarn, instead of passing through twister 480, may be passed over a driven consolidation roll indicated generally by reference numeral 508. As shown, the yarn emerging from twister 480 may pass over a guide roll 482 to wind-up roll 484 or be wound directly on wind-up roll 484 depending upon the geometrical configuration of the apparatus.

In a still further embodiment, the composite material may pass through a twister indicated generally by reference numeral 500. Twister 500 comprises a body portion 502 having an interior cavity 503 in which is mounted a tubular spindle 504 having slots or apertures 506 communicating with cavity 503. Tubular spindle 504 is rotatable within body 502 and a suction is provided within chamber 503 whereby the outer layers of fibers are subjected to a negative pressure. In passing through twister 500, the yarn is twisted and due to the suction provided, the outer fiber layer will wrap around the inner fiber core and, as discussed above, will lock in the twist.

FIG. 15 illustrates a still further embodiment of the present invention similar to that described with respect to FIG. 1 and reference will now be made thereto.

A first source of yarn forming material 604 is fed about guide members 610 to a fiberizing assembly designated generally by reference numeral 606. Assembly 606 may treat yarn forming material 604 in the manner such such as those discussed with respect to FIGS. 1 and 12.

The fibers thus formed in fiberizing assembly 606 are then transferred to a lickerin assembly comprising a lickerin roll 612 rotating in the direction shown by the arrows. In a similar manner, a second source of yarn forming material 602 is fed over guide members 614 to a second fiberizing assembly 608. The fibers from assembly 608 are then transferred to a second lickerin roll 618. It will be understood that the fiberizing assemblies and lickerin assemblies may be substantially identical to those previously described.

As shown, a collecting means comprising a rotatable drum or roll 620 is provided axially adjacent lickerin rolls 612 and 618; collecting drum 620 includes a central collecting trough 622. Preferably, trough 622 has apertures therein whereby a suctional force is provided on the surface thereof.

In operation, the staple length fibers on lickerin roll 612 are deflected or transferred to collecting trough 622 by deflecting means generally designated by reference numeral 624. As was the case described with respect to FIG. 1, the deflecting means may comprise pneumatic means or other suitable means for effecting the transfer of the staple length fibers to the collecting trough.

Following the transfer and deposition of the fibers from lickerin roll 612 to collecting trough 622, a pressure roll 626 mounted on arm 628 may be utilized to partially consolidate and form a layer of these fibers. Pressure roll 626 may be spring biased against trough 622 if desired.

Following this, the staple length fibers from lickerin roll 618 are deflected by deflecting means 630 to collecting trough 622 at a point downstream of where the initial layer of fibers are deposited. Again, the transfer and deposition of the fibers from lickerin roll 618 may be accomplished by means previously described or known to those skilled in this art.

Following the transfer of the two yarn forming materials to collecting means 620, the composite material may then pass through an "amplifying" device designated generally by reference numeral 632. Amplifying device 632 functions to attract the outer fibrous layer comprising the fibers of the second yarn forming material and to this end, may comprise suction means such as those designated generally by reference numeral 518 in FIG. 12.

Subsequently, the composite yarn materials 634 may pass over a suitable rubber or ceramic component 636 to a further yarn transforming means 638. Yarn transforming device 638 supplies a source of pressurized gaseous material to the yarn; which pressurized gaseous material assumes a whirlpool or vortex configuration in the manner described with respect to FIG. 12. Subsequently, the composite yarn product 634 is entrained about a guide roller 640 and thence to wind-up roll 642.

In an alternative embodiment, the source of a carrier material may be utilized in manufacturing a composite yarn product. Such a source is indicated generally by reference numeral 644 and as designated by reference numeral 646, the carrier may comprise a multifilament material. Such a multifilament carrier material may then pass through amplifying device 648 wherein it it subjected to a negative pressure or suction force — the filaments are amplified or "spread apart" as is shown generally by reference numeral 650.

Following the subjection of carrier material 644 to the negative pressure, the carrier is subsequently placed in juxtaposition to collecting trough 622 and the fibrous material is deposited thereon.

The various feed rolls, lickerin rolls and collecting roll may be driven individually or by a common drive means. Thus, as was previously discussed, the rotational speed of the various rolls may be tied together or the rotational speed of one roll may be varied with respect to a further roll. Drive belts connected to a suitable drive means are shown and designated generally by reference numeral 652.

FIG. 16 is an enlarged view of the yarn immediately after emergence from collecting trough 622 of collecting roll 620. As may be seen, the individual outer fibers 660 are helically and unidirectionally wound about an inner core which is formed of the first yarn forming material.

FIG. 17 is an enlargement of the composite yarn product after passing through device 632. While being subjected to a twisting force, the outer fibrous layers, as aforementioned, are subjected to a negative pressure or other like attraction means whereby the outer fibers interlock among themselves and the inner core. Upon being wound up, the interlocking of the outer fibrous layer will permit the retention of a positive twist in the composite yarn product.

As will be seen from the above description, and as will be understood by those skilled in this art having read the present disclosure, it will be understood that various modifications can be made to the above described embodiments without departing from the spirit of the invention. Thus, as will be seen from the above description, the feed rolls 30 and 32 permit fiber feed-in in a more controlled manner with respect to the fiber opening, separation, cleaning and as well as parallelization functions, and depending on the diameter of such rolls, substantially longer staple fibers can be utilized with the process and with the apparatus of the present invention compared to the feeding requirements for fiber strands when the fiber strands are fed directly into the fiber lickerin roll. When employing suction from within and without these rolls, the usual problems associated in spinning of the fiber fly and fiber wrap around will, to a large extent, be diminished.

From the above description, it will be seen that the basic improvements of the present invention will enable, for the first time, the provision of a highly compact apparatus and process, for the manufacture of a blended one hundred percent staple fiber of any length, and composite spun yarns of any composition in respect to the type of staple fiber, filament and polymer resin content; as well as the provision of spun yarns which are superior in appearance, hand, strength and evenness at linear production speeds of up to two thousand feet per minute, and possible much higher, with additional mechanical improvements, if desired. The hundred percent staple fiber yarns of this type may have a count range of one hundred tex and finer, whereas the range of the composite polymer containing yarns may be from 30 tex and coarser. However, there are no known basic technological and technical limitations against considerably extending the count scope in both cases. In respect to strength, evenness and appearance, said opposite directional or special unidirectional twist containing yarns will exceed conventional ring and open end spun yarns, not to mention the possible enormous production speed and output per spindle.

This invention will also enable the manufacture of numerous types of spun yarn of special properties in respect to appearance, performance and structure.

Thus, it is now possible with the process and apparatus of the present invention to engineer specific properties for yarns in the novel yarns of the present invention.

EXAMPLES

The following Tables I, II and III illustrate typical examples of the various processes and apparatus of this invention. In Examples 1 to 5 of Table I, the apparatus shown in the drawings was employed using only the two fiber feed in assemblies with no carrier of filament, to form a one component yarn of 100% staple fibers with the properties as shown.

Table II illustrates the results of Examples to 10 employing different materials, in forming a composite yarn product of two components using the apparatus and process of this invention. In this case, the apparatus and process were run using the first and second sources for providing particulate staple length fibers, with a carrier or filament core material being introduced between the two fiber feeds. If desired, in place of the above, either one of the staple fiber feeds may be used alone, rather than both together.

Referring to Table III, Examples 11 to 16 illustrate the use of the apparatus and process for forming three component yarn products. In this case, the two fiber feeds were used, together with a carrier or filament fed through the extruder while the extruder was operating. Also, in this case either one of the staple fiber feeds could be used alone.

TABLE I

| NO. | SPEED fpm | TWISTER rpm | ONE COMPONENT 100% staple fibers COUNT tex | FIBER Type | % | TENSILE grams | ELONGATION % |
|---|---|---|---|---|---|---|---|
| 1 | 325 | 225,000 | 79 | Polyester | 100 | 1200 | 20 |
| 2 | 320 | 225,000 | 70 | Polyester | 75 | 900 | 16.6 |
| | | | | Cotton | 25 | | |
| 3 | 900 | 700,000 | 60 | Polyester | 100 | 1000 | 15.4 |
| 4 | 600 | 400,000 | 65 | Polyester | 70 | 1125 | 16.2 |
| | | | | Viscose | 30 | | |
| 5 | 500 | 400,000 | 60 | Cotton | 100 | 950 | 14.2 |

TABLE II

| NO. | SPEED fpm | TWISTER rpm | TWO COMPONENTS - FIBERS wrapped around central core COUNT Tex | FIBER Type | % | Core type | % | TENSILE grams | ELONGATION % |
|---|---|---|---|---|---|---|---|---|---|
| 6 | 300 | 225,000 | 60 | Cotton | 33 | ICS yarn | 66 | 450 | 35 |
| 7 | 1500 | 50,000* | 80 | Polyester | 20 | ICS yarn | 80 | 875 | 14.8 |
| 8 | 1000 | 40,000* | 100 | Viscose | 20 | ICS yarn | 80 | 750 | 15.2 |
| 9 | 1000 | 700,000 | 40 | Polyester | 50 | Vis. Fil. | 50 | 800 | 14.0 |
| 10 | 500 | 300,000 | 70 | Polyester | 51 | PP tape | 49 | 1450 | 20.8 |

*Different twister type
Vis. Fil. Viscose Filament
PP Polypropylene

TABLE III

| No. | SPEED fpm | TWISTER rpm | COUNT Tex | THREE COMPONENTS Staple fiber - Carrier - Polymer FIBER Type | % | CARRIER Type | % | POLYMER Type | % | TENSILE grams | ELONGATION % |
|---|---|---|---|---|---|---|---|---|---|---|---|
| 11 | 1000 | 20,000 | 330 | Jute | 32 | PP Tape | 34 | PE | 34 | 1850 | 19.8 |
| 12 | 2000 | 20,000 | 100 | Waste Cot | 40 | Nylon | 16 | Reground Polyester | 44 | 800 | 16.5 |
| 13 | 4300 | 40,000 | 40 | Polyester | 38 | Nylon | 24 | Nylon | 38 | 600 | 16.4 |
| 14 | 2000 | 18,000 | 25 | Viscose | 33 | Nylon | 33 | Nylon | 33 | 450 | 15.2 |
| 15 | 2000 | 16,000 | 100 | Viscose | 33 | Glass | 33 | PP | 33 | 1850 | 4.1 |
| 16 | 2000 | 18,000 | 59 | Acrylic | 37 | Polyester | 26 | PP | 37 | 835 | 21.9 |

PP - Polypropylene
PE - Polyethylene
Waste Cot. - Waste Cotton

I claim:

1. An apparatus suitable for manufacturing a composite yarn product, said apparatus comprising first means for supplying a first yarn forming material comprised of individualized fibers in a non-coherent form, a movable collecting surface adapted to receive said first yarn forming material and for forming of non-coherent layer of said fibers on said collecting surface, means for supplying and feeding interfiber binding material to said collecting surface into juxtaposition with said layer of fibers at a point downstream in the direction of movement of said collecting surface from where said fibers are placed on said collecting surface, second means for supplying a second yarn forming material comprised of individualized fibers in a non-coherent form, and for placing said second yarn forming material in juxtaposition with said first yarn forming material and said interfiber binding material on said collecting surface and means for transforming the resulting composite material into a consolidated yarn product.

2. The apparatus of claim 1, wherein both said first and second yarn supplying means are adapted to supply staple fibers.

3. The apparatus of claim 1, wherein means for feeding interfiber binding material to said collecting surface comprises extruder means for feeding a filament of a tacky thermoplastic material.

4. The apparatus of claim 3, wherein said means for supplying a filament of inter-fiber binding material is adapted to supply a carrier strand of yarn forming material coated with a tacky thermoplastic material to said collecting surface.

5. The apparatus of claim 2, additionally comprising means for supplying a continuous carrier strand to said collecting surface.

6. The apparatus of claim 1, wherein said means for transforming the resulting composite material into a consolidated yarn product includes a rotatable false twist spindle having means for applying a negative pressure to the composite material passing therethrough.

7. The apparatus of claim 1, wherein at least one of said first or second means for supplying fibers comprises means for supplying low melt fibers, the apparatus including heating means to render said low melt yarn forming material to at least a tacky condition, and means for supplying a further yarn forming material in juxtaposition to the tacky low melt yarn forming material.

8. The apparatus of claim 1 wherein the apparatus includes means for subjecting the composite yarn product to a source of pressurized gaseous material having a vortex configuration.

9. In a composite yarn manufacturing apparatus suitable for manufacturing composite yarn products having an outer fibrous layer, including means for supplying a multi filament or multi fiber carrier strand of a yarn forming material, the improvement comprising means through which said carrier strand passes thereby creating an external amplifying force acting on said carrier strand such that the diameter of said carrier strand increases and the filaments or fibers of the strand are spread apart prior to the juxtaposition thereto of the fibers forming said outer fibrous layer.

10. In a twister for twisting composite yarn products formed of at least an inner layer of yarn forming material and an outer layer of a fibrous material, and wherein the composite yarn product is rotated, the improvement wherein said twister includes means through which said yarn product passes such that at least a portion of the fibers of said outer fibrous layer are attracted outwardly by said means.

11. A method of forming a composite yarn product, said method comprising the steps of supplying first individualized fibers in a non-coherent form, placing said first fibers on a movable collecting surface to form a layer thereof, supplying and placing an inter-fiber binding material into juxtaposition with said first fibers at a point downstream, in the direction of movement of said movable collecting surface of where said first fibers are placed on said movable collecting surface, placing second fibers into juxtaposition with said first fibers and inter-fiber binding material, and transforming the resulting composite material into a consolidated yarn product.

12. The method of claim 11 wherein the steps of supplying said first and second fibers comprise the steps of supplying first and second staple fiber material.

13. The method of claim 12 wherein the step of supplying said inter-fiber binding material comprises the step of extruding a filament of a tacky thermoplastic material and placing said filament of thermoplastic material in juxtaposition to said first fibers on said collecting surface.

14. The method of claim 11, wherein the step of supplying inter-fiber binding material comprises the step of supplying a continuous carrier strand of a yarn forming material, and the step of coating said carrier strand of yarn forming material with a tacky thermoplastic material.

15. The method of claim 14, wherein the step of coating said continuous carrier strand of yarn forming material with a tacky thermoplastic material comprises the step of passing the carrier strand through an extruder containing said thermoplastic material.

16. The method of claim 11, wherein at least one of said first and second fibers comprises low melt fibers, including the step of heating said low melt fibers to a tacky condition, and supplying a further source of fibers in juxtaposition thereto.

17. The method of claim 14 wherein said method includes the step of subjecting the composite yarn product to a source of pressurized gaseous material having a vortex configuration.

18. In a method of twisting during the manufacture of a composite yarn product having an inner layer of a yarn forming material and outer fibrous layer comprised of a plurality of fibers, the improvement which includes applying a force to the rotating yarn product such that at least a portion of the fibers of the outer fibrous layer are attracted outwardly by said force.

19. In a method for manufacturing composite yarn products having an inner multi filament or multi fiber core and an outer fibrous layer, the improvement comprising the step of applying a force to said core such that the diameter thereof expands and the filaments or fibers thereof are spaced apart prior to the juxtaposition thereto of the fibers forming said outer fibrous layer.

20. An apparatus suitable for the manufacture of composite yarn products, said apparatus comprising a rotatable collecting roll having a circumferentially extending grove, a first lickerin assembly for feeding first fibers to said collecting roll and forming a layer of the same in said groove, said first lickerin assembly being located on a first side of said collecting roll, a second lickerin assembly feeding second fibers to said collecting roll in juxtaposition to said first fibers, said second lickerin assembly being located on a second side of said collecting roll substantially diametrically opposed to said first side, means for supplying at least one filament of inter-fiber binding material to said groove on said collecting roll at a point downstream of the point where said first fibers are fed to said collecting roll and at a point upstream of the point where said second fibers are fed to said collecting roll, and means for transforming the resulting composite product into a consolidated yarn.

21. The apparatus of claim 20, wherein said collecting roll includes means for providing a suction force to said groove to retain said fibers thereon.

22. The apparatus of claim 21, wherein at least one of said first and second lickerin assemblies includes pneumatic means for transferring said fibers to said groove on said rotatable collecting roll.

23. The apparatus of claim 20, wherein said means for transforming the resulting composite product into a consolidated yarn comprises false twisting means.

24. The apparatus of claim 20, additionally including means for subjecting the composite yarn product to a source of pressurized gaseous material having a vortex configuration, said means being located in advance of the means for transforming the resulting composite product into a consolidated yarn.

25. The apparatus of claim 24, wherein said means for subjecting the composite yarn product to a source of pressurized gaseous material having a vortex configuration comprises a member having walls defining an interior chamber of a generally frusto-conical configuration, a plurality of apertures within said walls, and means for feeding a pressurized gaseous material to said apertures, said apertures directing said pressurized gaseous material in a vortex configuration from the narrower end of the frusto-conical configurated chamber to the wider end thereof, said chamber having means permitting the egress of said pressurized gaseous material located proximate the wider end of said frusto-conically configurated chamber.

26. The apparatus of claim 23, wherein said false twisting means includes a rotatable spindle, said spindle having at least one aperture therein, and means for supplying a suction force to said aperture.

27. An apparatus suitable for the manufacture of composite yarn comprising a rotatable collecting roll having a circumferentially extending groove, a first lickerin assembly for feeding first fibers to said collecting roll and forming a layer of fibers in the groove, said first lickerin assembly being located on a first side of said collecting roll, a second lickerin assembly for feeding second fibers to said collecting roll in juxtaposition to said first fibers, said second lickerin assembly being located on a second side of said collecting roll opposed to the side on which said first lickerin assembly is located, means for supplying a strand of carrier material to said groove on said collecting roll at a point downstream of the point where said first fibers are fed to said collecting roll and upstream of the point where said second fibers are fed to said collecting roll, and means for transforming the resulting composite product into a consolidated yarn.

28. The apparatus of claim 27, further including means for coating said strand of carrier material with a molten inter-fiber binding material.

29. The apparatus of claim 27, further including a chamber containing a lubricating agent, a kiss roll within said chamber, and means for passing said strand of carrier material through said chamber whereby said strand is contacted by said kiss roll.

30. The apparatus of claim 27, further including means for subjecting said strand of carrier material to an external amplifying force prior to contacting said fibers.

31. The apparatus of claim 30, wherein said means comprises a chamber through which said strand of carrier material passes, said chamber being operatively connected to a means creating a suction therein.

32. The apparatus of claim 27, further including means for subjecting the composite product to a source of pressurized gaseous material having a vortex configuration.

33. The apparatus of claim 32, wherein said means for subjecting the composite yarn product to a source of pressurized gaseous material having a vortex configuration comprises a member having walls defining an interior chamber of a generally frusto-conical configuration, a plurality of apertures within said walls, and means for feeding a pressurized gaseous material to said apertures, said apertures directing said pressurized gaseous material in a vortex configuration from the narrower end of the frusto-conical configurated chamber to the wider end thereof, said chamber having means permitting the egress of said pressurized gaseous material located proximate the wider end of said frusto-conically configurated chamber.

34. The apparatus of claim 26, wherein said false twisting means includes a rotatable spindle, said spindle having at least one aperture therein, and means for supplying the suction force to said aperture.

35. The apparatus as defined in claim 8, wherein said means for subjecting the composite product to a source of pressurized gaseous material having a vortex configuration comprises a member having walls defining an interior chamber of a generally frusto-conical configuration, a plurality of apertures within said walls, and means for feeding a pressurized gaseous material to said apertures, said apertures directing said pressurized gaseous material in a vortex configuration from the narrower end of the frusto-conical configurated chamber to the wider end thereof, said chamber having means permitting the egress of said pressurized gaseous material located proximate the wider end of said frusto-conically configurated chamber.

36. The apparatus of claim 10, wherein said means of supplying an external amplifying force to said yarn products comprises a rotatable spindle having apertures therein and wherein said yarn passes through said spindle, and means operatively associated with said rotatable spindle for supplying a suction force thereto.

37. The apparatus of claim 9, wherein said means of supplying an external amplifying force to said carrier comprises a chamber through which said carrier passes, and suction means operatively associated with said chamber to create a negative pressure therein.

38. The method of claim 11, wherein the step of transforming the resulting composite material into a consolidated yarn product comprises the step of false twisting the composite material.

39. The method of claim 38, wherein the step of false twisting the composite material includes the step of passing the composite material through the rotatable false twist spindle, and applying a suction force to said composite material while passing through said spindle.

40. A method of forming a composite yarn product, said method comprising the steps of supplying first individualized fibers in a non-coherent form, placing said first fibers on a movable collecting surface to form a layer thereof, supplying a continuous carrier strand of yarn forming material, applying a suction force to said carrier strand to expand the same, placing said carrier strand in juxtaposition with said first fibers at a point downstream in the direction of movement of said movable collecting surface of where said first fibers are placed thereon, and transforming the resulting composite material into a consolidated yarn product.

41. The method of claim 40 including the step of supplying second fibers, and placing said second fibers into juxtaposition with said first fibers and continuous carrier strand of yarn forming material.

* * * * *